US011719233B2

(12) United States Patent
Yao

(10) Patent No.: US 11,719,233 B2
(45) Date of Patent: Aug. 8, 2023

(54) POWER-SAVING OPTIMIZATION OPERATION METHOD AND SWITCHING POINT DETERMINING METHOD FOR WATER PUMP UNIT

(71) Applicant: Fulai Yao, Beijing (CN)

(72) Inventor: Fulai Yao, Beijing (CN)

( * ) Notice: Subject to any disclaimer, the term of this patent is extended or adjusted under 35 U.S.C. 154(b) by 0 days.

(21) Appl. No.: 17/339,381

(22) PCT Filed: Oct. 16, 2020

(86) PCT No.: PCT/CN2020/121509
§ 371 (c)(1),
(2) Date: Jun. 4, 2021

(87) PCT Pub. No.: WO2021/088620
PCT Pub. Date: May 14, 2021

(65) Prior Publication Data

US 2022/0120270 A1 Apr. 21, 2022

(30) Foreign Application Priority Data

Nov. 4, 2019 (CN) ..... 201911064017.2

(51) Int. Cl.
*F04B 23/04* (2006.01)
*F04B 49/06* (2006.01)
(Continued)

(52) U.S. Cl.
CPC ..... *F04B 49/007* (2013.01); *F04B 17/03* (2013.01); *F04B 23/04* (2013.01); *F04B 49/065* (2013.01);
(Continued)

(58) Field of Classification Search
CPC ..... F04B 17/03; F04B 23/04; F04B 49/007; F04B 49/065; F04B 49/20; F04B 2205/09
(Continued)

(56) References Cited

U.S. PATENT DOCUMENTS 5,259,731 A * 11/1993 Dhindsa ..... F04B 49/065 417/63
6,186,743 B1 * 2/2001 Romer ..... F04B 41/06 427/256
(Continued)

FOREIGN PATENT DOCUMENTS

CN 101270755 A 9/2008
CN 101509680 A 8/2009
(Continued)

OTHER PUBLICATIONS

International Search Report and Written Opinion of International Searching Authority for PCT/CN2020/121509, ISA/CN, Beijing, China, dated Dec. 20, 2021.
(Continued)

*Primary Examiner* — Charles G Freay
(74) *Attorney, Agent, or Firm* — M&B IP Analysts, LLC

(57) ABSTRACT

A power-saving optimization operation method and switching point determining method for a water pump unit. In the parallel water pump units, k water pumps converters form a sub-pump unit A. The water output $Q_1$ of a first water pump in the sub-pump unit A, the input power $P_1$ of the frequency converter corresponding to $Q_1$ and the operating frequency $f_1$ of the frequency converter corresponding to $Q_1$ are recorded, where $Q_A=Q_1$, $P_A=P_1$. The $Q_A$-$P_A$ curve of an operating water pump serves as the working curve $w_1$, where $Q_A=mQ_1$ and $P_A=mP_1$, and $k\geq m\geq 2$. The working curve $w_m$ of m operating water pumps operating at the same frequency is obtained, where $f_1=f_2= \ldots =f_m$. The intersection point of the working curve $w_{m-1}$ and the working curve $w_m$ is the optimal switching point between m-1 operating water pumps and m operating water pumps under the constant pressure $H_s$.

8 Claims, 4 Drawing Sheets

(51) Int. Cl.

| | |
|---|---|
| ***F04B 49/00*** | (2006.01) |
| ***F04B 49/20*** | (2006.01) |
| ***F04B 17/03*** | (2006.01) |
| ***F04B 49/08*** | (2006.01) |

(52) U.S. Cl.
CPC ..... *F04B 49/08* (2013.01); *F04B 49/20* (2013.01); *F04B 2203/0208* (2013.01); *F04B 2205/05* (2013.01); *F04B 2205/09* (2013.01)

(58) Field of Classification Search
USPC ..... 417/7
See application file for complete search history.

(56) References Cited

U.S. PATENT DOCUMENTS

| | | | | |
|---|---|---|---|---|
| 8,371,821 | B1 * | 2/2013 | Mehr | F04D 15/0218 417/40 |
| 2018/0314270 | A1 * | 11/2018 | Grøtterud | F04D 15/0066 |

FOREIGN PATENT DOCUMENTS

| | | | |
|---|---|---|---|
| CN | 107305055 | A | 10/2017 |
| CN | 109595746 | A | 4/2019 |
| CN | 110939560 | A | 3/2020 |
| JP | S59105983 | A | 6/1984 |
| TW | I273171 | B | 2/2007 |

OTHER PUBLICATIONS

Yao, Fulai. "Efficiency Optimization Method and Optimal Control of Mechanical and Electrical Equipments". Electronic Technology & Information Science, China Doctoral Dissertations Full-Text Database. Mar. 31, 2014. English translation of pp. 7-8, 13-16, and 107-108.

Yao, Fulai et al. "Optimal Method of the System Composed of Two Different Devices". (Non-official Translation: Proceedings of the 31st Chinese Control Conference, vol. B, Proceedings of Technical Committee on Control Theory, Chinese Association of Automation Conference), Jul. 25, 2012 (Jul. 25, 2012). English translation of pp. 2411-2414.

* cited by examiner

POWER-SAVING OPTIMIZATION OPERATION METHOD AND SWITCHING POINT DETERMINING METHOD FOR WATER PUMP UNIT

CROSS REFERENCE TO RELATED APPLICATION(S)

This application is a 371 application of an international patent application No. PCT/CN2020/121509 filed on Oct. 16, 2020. The PCT/CN2020/121509 This application claims priority from the Chinese patent application filed in China National Intellectual Property Administration on Nov. 4, 2019 having the Application NO. 201911064017.2 and entitled as "Power-Saving Optimization Operation Method And Switching Point Determining Method For Water Pump Unit", the entire content of which is incorporated in this application by reference.

TECHNICAL FIELD

The present disclosure relates to a power-saving operation method for a water pump unit, in particular to a power-saving optimization operation method and switching point determining method for a water pump unit.

BACKGROUND ART

A large number of parallel water pump units exist in secondary frequency conversion water supply devices, non-negative pressure frequency conversion water supply devices, superimposed pressure frequency conversion water supply devices, water supply water pump stations of factories and mines, circulating water pump stations, central air-conditioning refrigeration pump stations, cooling pump stations, water supply systems of water companies, municipal sewage water pump stations, drainage water pump stations, irrigation pump stations of agricultural departments and water transfer pump stations of water conservancy departments.

Many well-known electrical manufacturers in the world, such as ABB, Siemens, Fuji, Toshiba, AB, General Electric, etc., have launched products for energy-saving operation of water pumps. A speed controller is the most widely used technical means at present, and the rotating speed of water pumps can be adjusted by using the speed controller. Commonly used speed controllers include a frequency converter, a cascade speed controller, an electromagnetic speed controller and a hydraulic coupler, etc. At present, a frequency converter is applied most rapidly because of its relatively high operating efficiency. At present, the well-known speed controlling operation method of parallel water pump units is a conventional single closed-loop control method. The conventional single closed-loop control method has a single goal of meeting the technological requirements. There are no methods and measures to ensure the highest overall operation efficiency of the water pump units, thus causing the water pump units to be unable to operate under the lowest power consumption. At present, the well-known design method for the water pump unit is carried out according to the conventional design specification, but the design specification is only a guiding design principle, which does not guarantee the concrete device allocation method and quantitative energy-saving design index for the water pump unit to realize the most energy-saving operation. In addition, the operation efficiency of the water pump after speed control by the frequency converter is changed under different pressures and flows. The factory data of a motor does not provide the efficiency change curve of the motor under different frequencies and different load rates. The factory data of a frequency converter does not provide the efficiency change curve under different frequencies and different load rates either. Based on these factors, it is very difficult to determine the optimal power-saving operation mode of speed control operation of parallel water pump units.

Chinese Patent Application No. 200810099427.6, filed on May 11, 2008 and entitled as "Speed-controlling and Switching Method for Controlling Parallel-Connection Energy-Saving Operation of Water Pump", gives the speed controlling and switching method for controlling the parallel energy-saving operation of water pumps, and gives the power-saving pump set switching characteristics and the power-saving speed controlling method, which is a milestone invention in this field. However, the patent does not give the method for finding and determining these optimal switching points and the operation method.

SUMMARY

In order to find and determine the power-saving optimal switching point and the optimal operation method for a water pump unit in engineering, the present disclosure provides a power-saving optimization operation method and switching point determining method for a water pump unit, which can conveniently determine the optimal switching point for a water pump unit in engineering application and give a power-saving operation control method.

According to the technical scheme adopted by the present disclosure for solving the technical problems is as follows: in the parallel water pump units, k water pumps of the same model equipped with frequency converters form a sub-pump unit A, k is an integer greater than 1, k1 water pumps of other models are provided, k1 is an integer greater than or equal to 0, the parallel water pump units use a constant pressure operation mode, the constant pressure value is $H_s$, the constant pressure value $H_s$ is the value equivalent to the total head of the water pump unit, the density of the delivered liquid is ρ, the total water output of the sub-pump unit A is $Q_A$, the total input power of the frequency converter in the sub-pump unit A is $P_A$, any water pump in the sub-pump unit A is designated as a first water pump, the water output of the first water pump in the sub-pump unit A is $Q_i$, the input power of the frequency converter is $P_i$, the operating frequency is $f_i$, $Q_A=Q_1+Q_2+\ldots+Q_k$, $P_A=P_1+P_2+\ldots+P_k$, for the sub-pump unit A, the $\rho^{\alpha}Q_A^{\varphi}H_s^{\lambda}P_A^{\mu}-\beta\rho^{\omega}Q_A^{\delta}H_s^{\xi}P_A^{\sigma}$ curve obtained under the constant pressure operation mode serves as the working curve w, the working curve w can be referred to as the working equation or working function, the optimal switching point and the optimal operation method of the sub-pump unit A are obtained, α, φ, λ, μ, β, ω, δ, and σ are coefficients, $\beta\neq 0$, φ and cannot be equal to 0 at the same time, φ and δ cannot be equal to 0 at the same time, a and S cannot be equal to 0 at the same time, σ and δ cannot be equal to 0 at the same time. When the parallel water pump units keep the operating status of the constant pressure $H_s$, the water output $Q_1$ of a first water pump in the sub-pump unit A and the input power $P_1$ of the frequency converter corresponding to the first water pump corresponding to $Q_1$ are recorded, where $Q_{1Max}(H_s)\geq Q_1\geq 0$, $Q_{1Max}(H_s)$ is the water output corresponding to the maximum allowable frequency $f_{max}$ when the first water pump frequency converter keeps the operating status of the constant pressure $H_s$, and $f_{max}$ is one of the power supply frequency of the power grid and the power supply frequency corresponding to the rated speed ne of the first water pump; $Q_A=Q_1$, $P_A=P_1$, the working curve $w_1$ of an operating water pump is obtained; $Q_A=(m-1)\ Q_1$ and $P_A=(m-1)\ P_1$, where m is a positive integer, and $k\geq m\geq 2$; the working curve $w_{m-1}$ of m-1 operating water pumps operating at the same frequency is obtained, where $f_1=f_2=\ldots=f_{m-1}$, $Q_A=mQ_1$ and $P_A=mP_1$, where m is a positive integer, and $k\geq m\geq 2$; the working curve $w_m$ of m operating water pumps operating at the same frequency is obtained, where $f_1=f_2=\ldots=f_m$; the intersection point of the working curve $w_{m-1}$ and the working curve $w_m$ is the optimal switching point between m-1 operating water pumps and m operating water pumps under the constant pressure $H_s$, where $Q_A=Q_{m-1,\ m}$, $P_A=P_{m-1,\ m}$; at the intersection point, $H_s$ is the same, $Q_A$ is the same and $P_A$ is the same, so that the efficiency of m-1 operating water pumps is the same as that of m operating water pumps, which is referred to as "equivalent switching"; if there is no intersection point between the working curve $w_{m-1}$ and the working curve $w_m$, the switching point between m-1 operating pumps and m operating pumps is that the output frequency of the frequency converter corresponding to m-1 operating pumps is equal to point $f_{max}$, $f_{max}$ is one of the power supply frequency of the power grid and the power supply frequency corresponding to the rated speed ne of the first water pump; $Q_{m-1}$, m is the optimal switching point expressed by the total water output of the sub-pump unit A, $P_{m-1}$, m is the optimal switching point expressed by the total input power of the frequency converter in the sub-pump unit A, m-1 water pumps operate, $f_1=f_2=\ldots=f_{m-1}$, m water pumps operate, $f_1=f_2=\ldots=f_m$, the frequency converters corresponding to the operating water pumps of the same model operate at the same output frequency, which is referred to as "the same pump with the same frequency", and $Q_i$, $P_i$, $H_s$ and the operating efficiency of each operating water pump are the same; when m=2, the optimal switching points are $Q_A=Q_{1,\ 2}$, $P_A=P_{1,\ 2}$, and when m=k, the optimal switching points are $Q_A=Q_{k-1,k}$, $P_A=P_{k-1,\ k}$; in engineering application, any one of $Q_{m-1,\ m}$ and $P_{m-1,\ m}$ is taken as the value of the optimal switching point between m-1 operating water pumps and m operating water pumps of the sub-pump unit A under the constant pressure $H_s$. Because two absolutely equal field values cannot be found in the engineering application, the instrument itself has errors, and many pump units have time limits on the start-stop interval of water pumps, it is necessary to avoid frequent switching of the number of operating water pumps near the optimal switching point. Considering these factors, the actual switching point value is within a range near the optimal switching point. In the sub-pump unit A, the actual switching point is taken as the value of the optimal switching point multiplied by $(1-\theta_1)$ when the number of operating water pumps increases from m-1 to m, where $0.15\geq\theta_1\geq 0$, and the actual switching point is taken as the value of the optimal switching point multiplied by $(1-\varepsilon_1)$ when the number of operating water pumps is reduced from m to m-1, where $0.15\geq\varepsilon_1\geq 0$. That is to say, the value near the optimal switching point is used as the actual switching point value. When the value is greater than the switching point value, the number of operating water pumps is increased, and when the value is less than the switching point value, the number of operating water pumps is decreased. At the actual switching point, the number of operating water pumps can be maintained, or the number of operating water pumps can be switched. These actual switching points are approximate optimal switching points. Different constant voltage operating values $H_s$ have different optimal switching points and actual switching points.

$Q_{m-1,\ m}$ is the optimal switching point of m-1 operating water pumps and m operating water pumps in the sub-pump unit A obtained above and expressed by the total water output of the sub-pump unit A, $k\geq m\geq 2$. For the sub-pump unit A, the curve $\rho^{\alpha}Q_{A\gamma\varphi}H_s^{\lambda}f_A^{\gamma}-\nu\rho^{\omega}Q_A^{\delta}H_s^{\xi}f_A^{\psi}$ obtained under the constant pressure operation mode is taken as the frequency curve y, and the frequency curve can also be referred to as the frequency equation or frequency function. $Q_{m-1,\ m}$ is used to obtain the optimal frequency switching point and the optimal operation method of the sub-pump unit A, $\alpha$, $\varphi$, $\lambda$, $\gamma$, $\nu$, $\omega$, $\delta$, $\xi$, $\psi$ are coefficients, $\nu\neq 0$, $\varphi$ and $\gamma$ cannot be equal to 0 at the same time, $\varphi$ and $\delta$ cannot be equal to 0 at the same time, $\psi$ and $\delta$ cannot be equal to 0 at the same time, and $\psi$ and $\gamma$ cannot be equal to 0 at the same time. When the parallel water pump units keep the operating status of the constant pressure $H_s$, the water output $Q_1$ of a first water pump in the sub-pump unit A and the frequency $f_1$ of the frequency converter corresponding to $Q_1$ are recorded, where $Q_A=Q_1$, $f_A=f_1$, $f_A$ represents the value expressed by one frequency when the output frequencies of all operating frequency converters in the sub-pump unit A are the same, the frequency curve $y_1$ of an operating water pump is obtained, $Q_A\ (m-1)\ Q_1$ and $f_A=f_1$, where m is a positive integer and $k\geq m\geq 2$; the frequency curve $y_{m-1}$ of m-1 operating water pumps operating at the same frequency is obtained, where $f_A=f_1=f_2=\ldots=f_{m-1}$; $Q_A\ mQ_1$ and $f_A=f_1$, where m is a positive integer and $k\geq m\geq 2$; the frequency curve $y_m$ of m operating water pumps operating at the same frequency is obtained, $f_A=f_1=f_2=\ldots=f_m$; the switching point on the frequency curve of $Q_{m-1,\ m}$ corresponding to $y_{m-1}$ is $f_{m-1,\ m}$, $f_{m-1,\ m}$ is the operating frequency of the frequency converters of m-1 operating water pumps at the optimal switching point, the switching point on the frequency curve of $Q_{m-1}$, m corresponding to $y_m$ is $f_{m,\ m-1}$, $f_{m,\ m-1}$ is the operating frequency of the frequency converters of m operating water pumps at the optimal switching point, where $f_{m-1,\ m}>f_{m,\ m-1}$. n engineering application, in the sub-pump unit A, the actual switching point is taken as $f_{m-1,\ m}\ (1+\theta_2)$ when the number of operating water pumps increases from m-1 to m, where $0.15\geq\theta_2\geq 0$, and the actual switching point is taken as $f_{m,\ m-1}\ (1-\varepsilon_2)$ when the number of operating water pumps is reduced from m to m-1, where $0.15\geq\varepsilon 2\geq 0$. Two absolutely equal values cannot be found in the engineering application, only the approximate value near the optimal switching point can be found, the instrument itself has errors, many pump units have time limits on the start-stop interval of water pumps, and it is necessary to avoid frequent switching of the number of operating water pumps near the optimal switching point. Considering these factors, the actual switching point value is within a range near the optimal switching point. In the sub-pump unit A, the actual switching point is taken as $f_{m-1,\ m}\ (1+\theta_2)$ when the number of operating water pumps increases from m-1 to m, where $0.15\geq\theta_2\geq 0$, and the actual switching point is taken as $f_{m,\ m-1}\ (1-\varepsilon_2)$ when the number of operating water pumps is reduced from m to m-1, where $0.15\geq\varepsilon_2\geq 0$. That is to say, the value near the optimal switching point is used as the actual switching point value. When the value is greater than the switching point value, the number of operating water pumps is increased, and when the value is less than the switching point value, the number of operating water pumps is decreased. At the actual switching point, the number of operating water pumps can be maintained, or the number of operating water pumps can be switched. These actual switching points are approximate optimal switching points. Different constant voltage operating values $H_s$ have different optimal switching points and actual switching points using the same method. Regardless of the slip factor, the frequency and the rotating speed are in one-to-one correspondence, and the operating frequency of the frequency converter at the optimal switching point and the rotating speed of the water pump at the optimal switching point are also in one-to-one correspondence.

When $\omega=1$, $\delta=1$, $\xi=1$, $\sigma=-1$ and $\beta=\beta_1$, $\beta\rho^{\omega}Q_A^{\delta}H_s^{\xi}P_A^{\sigma}=\beta_1\rho Q_A H_s/P_A$, $\beta_1\rho Q_A H_s/P_A$ represents the operating efficiency $\eta(H_s)$ of the sub-pump unit A, $P_i$ is a coefficient, the sub-pump unit A operates under the constant pressure $H_s$, the optimal switching point is used to switch the number of operating water pumps, and when $Q_A \geq Q_{1,2}$, the operating efficiency of the sub-pump unit A is $\eta(H_s) \geq \beta_1 \rho Q_{1,2} H_s/P_{1,2}$.

When the liquid delivered by parallel water pump units is clear water, $\rho$ is 1 ton/m$^3$, $H_s$ is in unit of meters, $Q_A$ is in unit of m$^3$/h, $P_A$ is in unit of kilowatts, and $\beta_1$ is equal to 1/367.2.

In engineering application, the control method of "the same pump with the same frequency" uses the bus communication signal and the analog output signal of the controller to send the same frequency value to all frequency converters at one time.

In addition, corresponding to the technical scheme provided above, the present disclosure further correspondingly provides another power-saving optimization operation method and switching point determining method for a water pump unit. The power-saving optimization operation method and switching point determining method for a water pump unit comprise:

acquiring the water output of each water pump in the water pump unit, the constant pressure value of the water pump unit, the input power of each frequency converter and the density of liquid delivered by the water pump unit;

determining the total water output for a water pump unit according to the water output of each water pump, and determining the total input power of a frequency converter in the water pump unit according to the input power of each frequency converter;

acquiring a first specific coefficient set; wherein the first coefficient set comprises $\alpha$, $\varphi$, $\lambda$, $\gamma$, $\nu$, $\omega$, $\delta$, $\xi$, $\gamma\psi$, where $\nu\neq0$, $\varphi$ and $\gamma$ cannot be equal to 0 at the same time, $\varphi$ and $\delta$ cannot be equal to 0 at the same time, $\psi$ and $\delta$ cannot be equal to 0 at the same time, and $\psi$ and $\gamma$ cannot be equal to 0 at the same time;

determining and obtaining the working curve in the constant pressure operation mode according to the total water output, the constant pressure value of the water pump unit, the total input power of the frequency converter, the density of the liquid delivered by the water pump unit and the first specific coefficient set;

determining the optimal switching point and the optimal operation method of each water pump in the water pump unit according to the working curve;

The power-saving optimization operation method and switching point determining method for a water pump unit further comprise:

acquiring the operating frequency and a second specific coefficient set of each water pump in the water pump unit; wherein the second specific coefficient set comprises $\alpha$, $\varphi$, $\lambda$, $\gamma$, $\nu$, $\omega$, $\delta$, $\xi$, $\gamma\psi$, where $\nu\neq0$, $\varphi$ and $\gamma$ cannot be equal to 0 at the same time, $\varphi$ and $\delta$ cannot be equal to 0 at the same time, $\psi$ and $\delta$ cannot be equal to 0 at the same time, and $\psi$ and $\gamma$ cannot be equal to 0 at the same time;

determining and obtaining the frequency curve in the constant pressure operation mode according to the total water output, the constant pressure value of the water pump unit, the operating frequency and the second specific coefficient set;

determining the optimal switching point and the optimal operation method of each water pump in the water pump unit according to the frequency curve.

The present disclosure has the following beneficial effect: first, the working curve of an operating water pump under the condition of speed controlling and constant pressure is obtained, all the working curves from two operating water pumps to k operating water pumps are directly drawn, and the optimal switching points are obtained through the intersection points of these working curves. It is easy to realize this method in engineering. According to these optimal switching points, the number of operating water pumps can be switched and the speed of operating water pumps can be adjusted and controlled, which can ensure that the sub-pump unit A operates in a high-efficiency state.

BRIEF DESCRIPTION OF THE DRAWINGS

In order to explain the embodiments of the present disclosure or the technical scheme in the prior art more clearly, the drawings needed in the embodiments will be briefly introduced hereinafter. Obviously, the drawings in the following description are only some embodiments of the present disclosure. For those skilled in the art, other drawings can be obtained according to these drawings without paying creative labor.

DETAILED DESCRIPTION OF THE EMBODIMENTS

The technical scheme in the embodiments of the present disclosure will be described clearly and completely hereinafter with reference to the drawings in the embodiments of the present disclosure. Obviously, the described embodiments are only some embodiments of the present disclosure, rather than all of the embodiments. Based on the embodiments of the present disclosure, all other embodiments obtained by those skilled in the art without paying creative labor belong to the scope of protection of the present disclosure.

The purpose of the present disclosure is to provide a power-saving optimization operation method and switching point determining method for a water pump unit, so as to find and determine the power-saving optimal switching point and the optimal operation method for a water pump unit in engineering.

Figure 5:
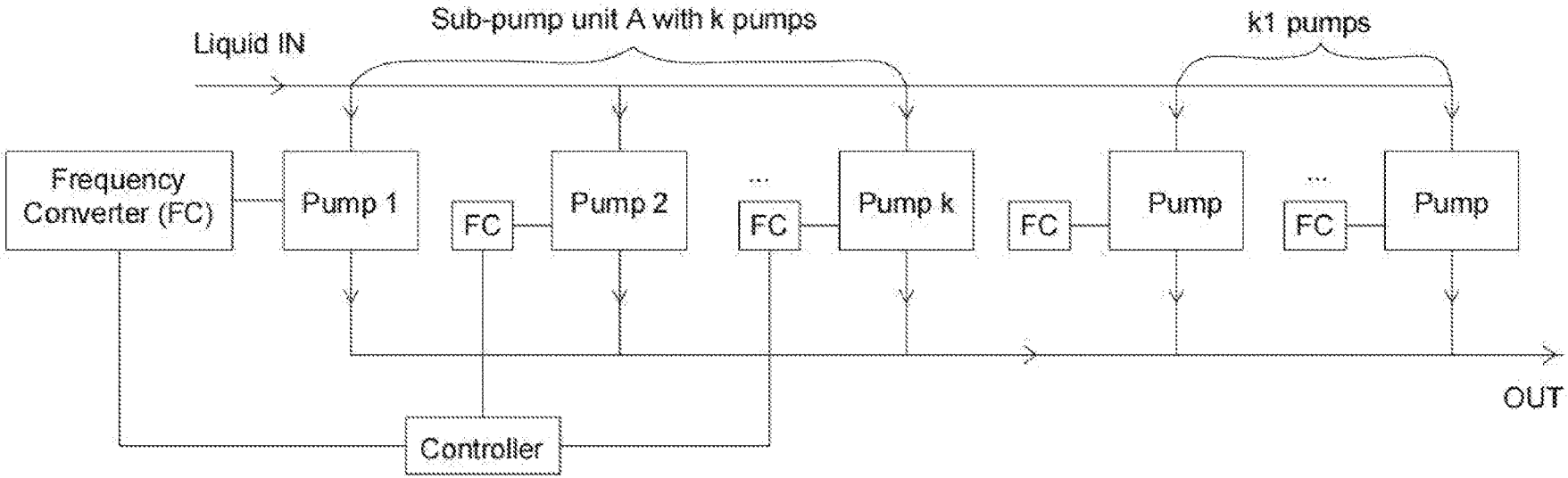
FIG. 5 is a schematic structural view of a water pump unit according to the present disclosure.

Referring to FIG. 5, all water pumps in the water pump unit are connected in parallel. The water pump unit comprises a sub-pump unit A having k water pumps with an identical model and other sub-pump units having k1 water pumps with other models, each water pump is equipped with a frequency converter, k is an integer greater than 1, and k1 is an integer greater than or equal to 0. In the sub-pump unit A, all frequency converters are connected to a controller.

In order to make the above objects, features and advantages of the present disclosure more obvious and understandable, the present disclosure will be further explained in detail hereinafter with reference to the drawings and specific embodiments.

Figure 1:
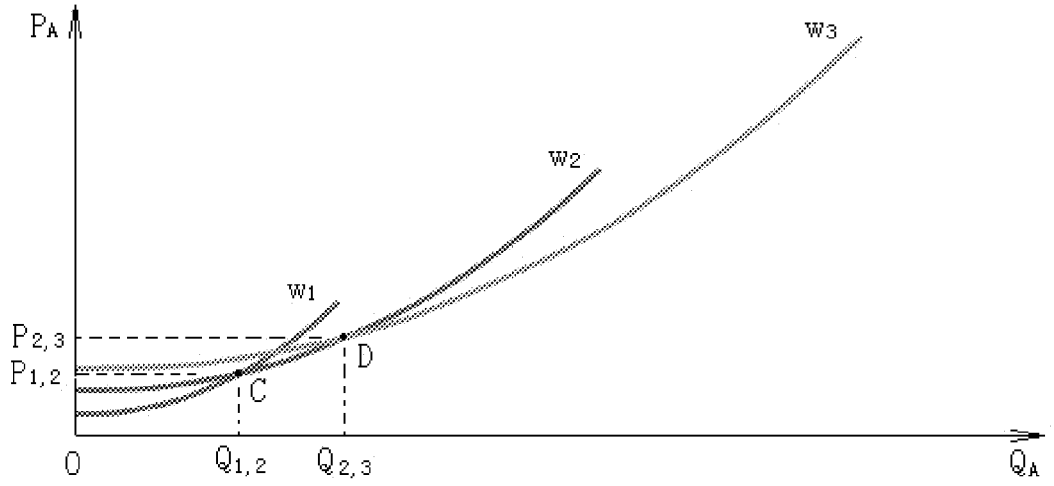
FIG. 1 is an embodiment of using $Q_A$-$P_A$ curve as a working curve to obtain the optimal switching point and the optimal speed controlling method when k=3.

In FIG. 1, in the parallel water pump units, three water pumps of the same model equipped with frequency converters form a sub-pump unit A, k=3. No water pumps of other models are provided, k1=0. The parallel water pump units use a constant pressure operation mode with the constant pressure value $H_s$=17 (meters). The constant pressure value is the constant pressure value of the total head of the water pump unit. The water pump unit delivers clean water, and any water pump in the sub-pump unit A is designated as the first water pump. The water output of the i-th water pump in the sub-pump unit A is $Q_i$, the input power of the frequency converter is $P_i$, the operating frequency is $f_i$, the total water output of the sub-pump unit A is $Q_A$, and the total input power of the frequency converter in the sub-pump unit A is $P_A$, $Q_A=Q_1+Q_2+Q_3$, $P_A=P_1+P_2+P_3$. $\alpha=0$, $\varphi=1$, $\lambda=0$, $\mu=0$, $\beta=1$, $\omega=0$, $\delta=0$, $\xi=0$, $\sigma=1$. $\rho^{\alpha}Q_A^{\varphi}H_s^{\lambda}P_A^{\mu}-\beta\rho^{\omega}Q_A^{\delta}H_s^{\xi}P_A^{\sigma}$ becomes $Q_A-P_A$. $Q_A$-$P_A$ is used as the working curve w. While keeping the operating status of the constant pressure $H_s$=17 (meters), the water output $Q_1$ of a first water pump in the sub-pump unit A and the input power $P_1$ of the frequency converter corresponding to $Q_1$ are recorded, where $Q_A=Q_1$, $P_A=P_1$. The $Q_A$-$P_A$ curve of an operating water pump is taken as the working curve $w_1$, where $Q_A=2Q_1$ and $P_A=2P_1$. The working curve $w_2$ of two operating water pumps is obtained, where $Q_A=3Q_1$ and $P_A=3P_1$. The working curve $w_3$ of three operating water pumps is obtained. The working curve $w_1$ and the working curve $w_2$ intersect at point C, which is the optimal switching point between an operating water pump and two operating water pumps under the constant pressure $H_s$=17 (meters), where $Q_A=Q_{1,2}$, $P_A=P_{1,2}$; $P_{1,2}$ is selected as the optimal switching point. At the intersection point, $H_s$ is the same, $Q_A$ is the same and $P_A$ is the same, so that the efficiency of an operating water pump is the same as that of two operating water pumps, which is referred to as "equivalent switching". When $P_A>P_{1,2}$, an operating water pump is switched to two operating water pumps. When two water pumps are operating, $f_1=f_2$ is kept. The frequency converters corresponding to the operating water pumps of the same model operate at the same output frequency, which is referred to as "the same pump with the same frequency", where $Q_1=Q_2$, $P_1=P_2$. $H_s$ is the same. When $P_A<P_{1,2}$, two operating water pumps are switched to one operating water pump. The working curve $w_2$ and the working curve $w_3$ intersect at point D, which is the optimal switching point between two operating water pumps and three operating water pumps under the constant pressure $H_s$=17 (meters), where $Q_A=Q_{2,3}$, $P_A=P_{2,3}$; $P_{2,3}$ is selected as the optimal switching point. When $P_A>P_{2,3}$, two operating water pumps are switched to three operating water pumps. When three water pumps are operating, $f_1=f_2=f_3$ is kept. When $P_A<P_{2,3}$, three operating water pumps are switched to two operating water pumps, and $f_1=f_2$ is kept. The process requirements have time limits on the start-stop interval of water pumps. In order to avoid frequent switching of the number of operating water pumps near the optimal switching point, the value of the actual switching point is within a range near the optimal switching point. When the number of operating water pumps increases from 1 to 2, the actual switching point is $P_{1,2}$ (1+0.08), and when the number of operating water pumps decreases from 2 to 1, the actual switching point is $P_{1,2}$ (1−0.08). When the number of operating water pumps increases from 2 to 3, the actual switching point is $P_{2,3}$ (1+0.08), and when the number of operating water pumps decreases from 3 to 2, the actual switching point is $P_{2,3}$ (1−0.08). The value near the optimal switching point is used as the actual switching point value. The number of operating water pumps is maintained at the switching point, the number of operating water pumps is increased when it is greater than the switching point value, and the number of operating water pumps is decreased when it is less than the switching point value. These actual switching points are approximately optimal switching points. For different constant voltage operating values $H_s$, different optimal switching points and different actual switching points are obtained by the same method.

Figure 2:
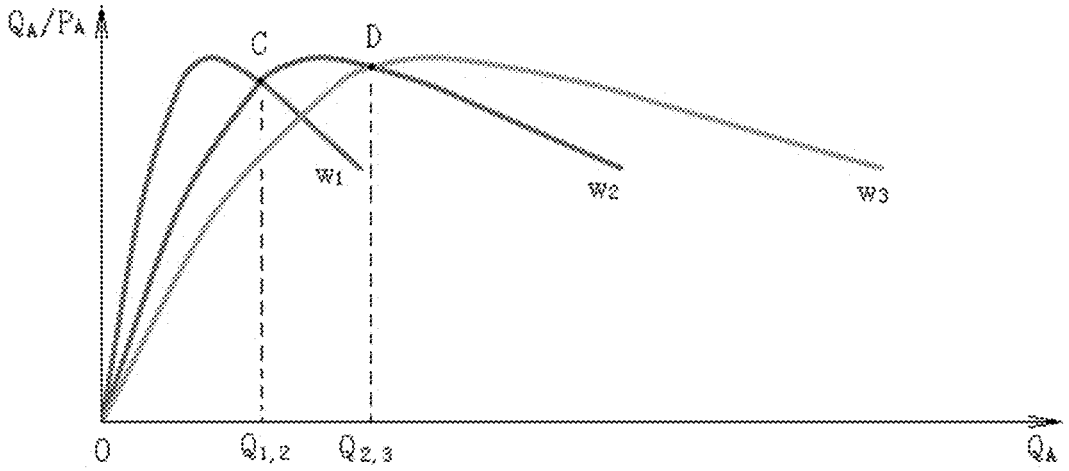
FIG. 2 is an embodiment of using $Q_A$-$Q_A/P_A$ curve as a working curve to obtain the optimal switching point and the optimal speed controlling method when k=3.

In FIG. 2, in the parallel water pump units, three water pumps of the same model equipped with frequency converters form a sub-pump unit A, k=3. No water pumps of other models are provided, k1=0. The parallel water pump units use a constant pressure operation mode with the constant pressure value $H_s$=17 (meters). The constant pressure value is the constant pressure value of the total head of the water pump unit. The water pump unit delivers clean water, and any water pump in the sub-pump unit A is designated as the first water pump. The water output of the i-th water pump in the sub-pump unit A is $Q_i$, the input power of the frequency converter is $P_i$, the operating frequency is $f_1$, the total water output of the sub-pump unit A is $Q_A$, and the total input power of the frequency converter in the sub-pump unit A is $P_A$, $Q_A=Q_1+Q_2+Q_3$, $P_A=P_1+P_2+P_3$. $\alpha=0$, $\varphi=1$, $\lambda=0$, $\mu=0$, $\beta=1$, $\omega=0$, $\delta=0$, $\xi=0$, $\sigma=1$. $\rho^{\alpha}Q_A^{\varphi}H_s^{\lambda}P_A^{\mu}-\beta\rho^{\omega}Q_A^{\delta}H_s^{\xi}P_A^{\sigma}$ becomes $Q_A-Q_A/P_A$. $Q_A-Q_A/P_A$ is used as the working curve w. While keeping the operating status of the constant pressure $H_s$=17 (meters), the water output $Q_1$ of a first water pump in the sub-pump unit A and the input power $P_1$ of the frequency converter corresponding to $Q_1$ are recorded, where $Q_A=Q_1$, $P_A=P_1$. The $Q_A-Q_A/P_A$ curve of an operating water pump is taken as the working curve $w_1$, where $Q_A=2Q_1$ and $P_A=2P_1$. The working curve $w_2$ of two operating water pumps is obtained, where $Q_A=3Q_1$ and $P_A=3P_1$. The working curve $w_3$ of three operating water pumps is obtained. The working curve $w_1$ and the working curve $w_2$ intersect at point C, which is the optimal switching point between an operating water pump and two operating water pumps under the constant pressure $H_s$=17 (meters), where $Q_A=Q_{1,2}$; $Q_{1,2}$ is selected as the optimal switching point. When $Q_A>Q_{1,2}$, an operating water pump is switched to two operating water pumps. When two water pumps are operating, $f_1=f_2$ is kept. When $Q_A<Q_{1,2}$, two operating water pumps are switched to one operating water pump. The working curve $w_2$ and the working curve $w_3$ intersect at point D, which is the optimal switching point between two operating water pumps and three operating water pumps under the constant pressure $H_s$=17 (meters), where $Q_A=Q_{2,3}$; $Q_{2,3}$ is selected as the optimal switching point. When $Q_A\geq Q_{2,3}$, two operating water pumps are switched to three operating water pumps. When three water pumps are operating, $f_1=f_2=f_3$ is kept. When $Q_A<Q_{2,3}$, three operating water pumps are switched to two operating water pumps, and $f_1=f_2$ is kept. The process requirements have time limits on the start-stop interval of water pumps. In order to avoid frequent switching of the number of operating water pumps near the optimal switching point, the value of the actual switching point is within a range near the optimal switching point. When the number of operating water pumps increases from 1 to 2, the actual switching point is $Q_{1,2}$ (1+0.04), and when the number of operating water pumps decreases from 2 to 1, the actual switching point is $Q_{1,2}$ (1−0.04). When the number of operating water pumps increases from 2 to 3, the actual switching point is $Q_{2,3}$ (1+0.04), and when the number of operating water pumps decreases from 3 to 2, the actual switching point is $Q_{2,3}$ (1−0.04). That is to say, the value near the optimal switching point is used as the actual switching point value. The number of operating water pumps is maintained at the switching point, the number of operating water pumps is increased when it is greater than the switching point value, and the number of operating water pumps is decreased when it is less than the switching point value. These actual switching points are approximately optimal switching points. For different constant voltage operating values $H_s$, different optimal switching points and different actual switching points are obtained by the same method.

Figure 3:
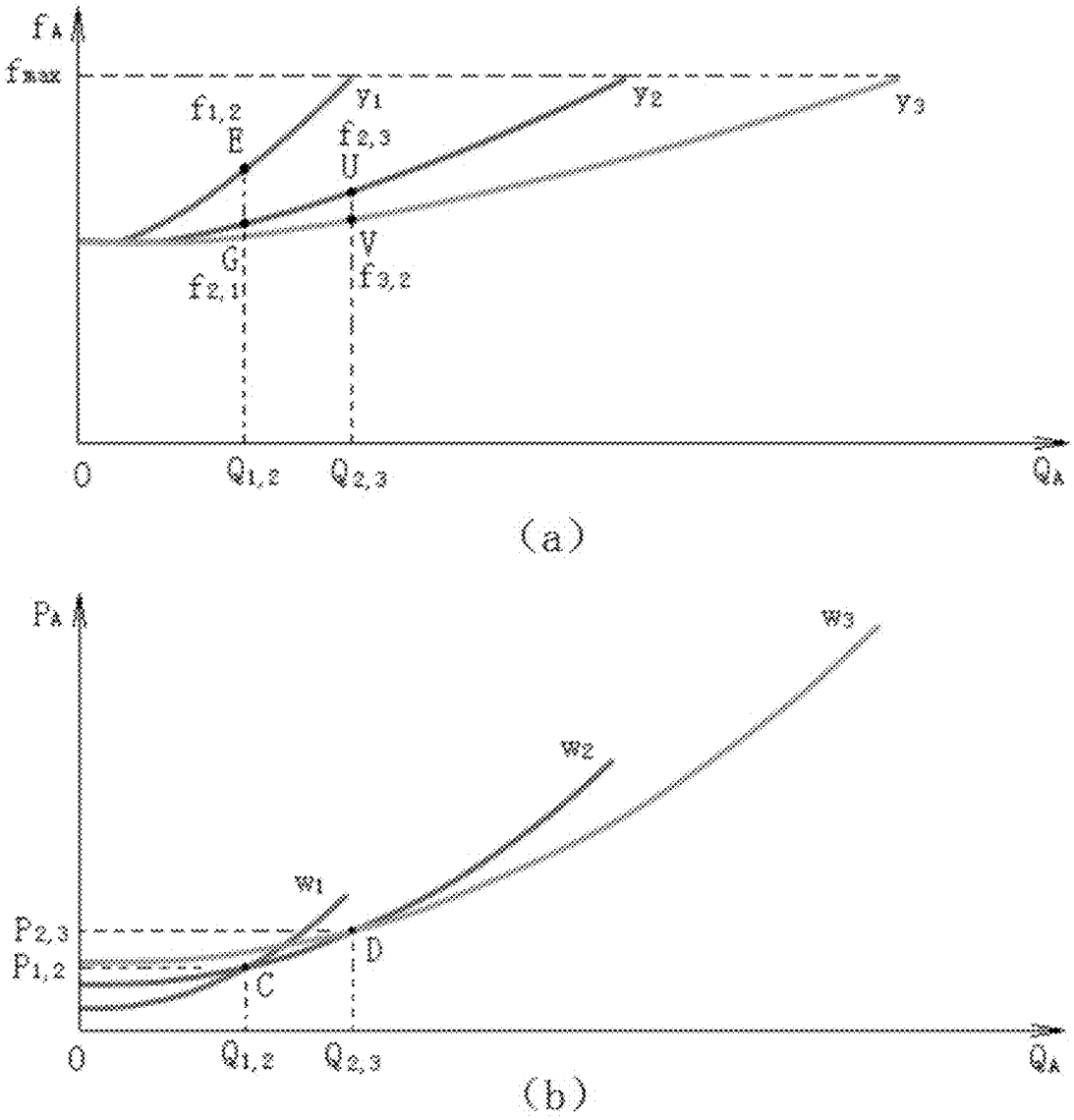
FIG. 3 is an embodiment of using $Q_A$-$P_A$ curve and $Q_A$-$f_A$ curve to obtain the optimal switching point and the optimal speed controlling method when k=3.

In FIG. 3(*a*) and FIG. 3(*b*), in the parallel water pump units, three water pumps of the same model equipped with frequency converters form a sub-pump unit A, k=3. No water pumps of other models are provided, k1=0. The parallel water pump units use a constant pressure operation mode with the constant pressure value $H_s$=17 (meters). The constant pressure value is the constant pressure value of the total head of the water pump unit. The water pump unit delivers clean water, and any water pump in the sub-pump unit A is designated as the first water pump. The water output of the i-th water pump in the sub-pump unit A is $Q_1$, the input power of the frequency converter is $P_i$, the operating frequency is $f_1$, the total water output of the sub-pump unit A is $Q_A$, and the total input power of the frequency converter in the sub-pump unit A is $P_A$, $Q_A=Q_1+Q_2+Q_3$, $P_A=P_1+P_2+P_3$. $\alpha=0$, $\varphi=1$, $\lambda=0$, $\mu=0$, $\beta=1$, $\omega=0$, $\delta=0$, $\xi=0$, $\sigma=1$. $\rho^{\alpha}Q_A^{\varphi}H_s^{\lambda}f_A^{\gamma}-\nu\rho^{\omega}Q_A^{\delta}H_s^{\xi}f_A^{\psi}$ becomes $Q_A-f_A$. $Q_A-f_A$ is used as the working curve y. While keeping the operating status of the constant pressure $H_s$=17 (meters), the water output $Q_1$ of a first water pump in the sub-pump unit A, the input power $P_i$ of the frequency converter corresponding to $Q_1$ and the operating frequency $f_1$ of the frequency converter corresponding to $Q_1$ are recorded, where $Q_A=Q_1$, $P_A=P_i$. The working curve $w_1$ of an operating water pump is obtained, where $Q_A=2Q_1$ and $P_A=2P_1$. The working curve $w_2$ of two operating water pumps is obtained, where $Q_A=3Q_1$ and $P_A=3P_1$. The working curve $w_3$ of three operating water pumps is obtained. The working curve $w_1$ and the working curve $w_2$ intersect at point C, which is the optimal switching point between an operating water pump and two operating water pumps under the constant pressure $H_s$=17 (meters), where $Q_A=Q_{1,2}$. The working curve $w_2$ and the working curve $w_3$ intersect at point D, which is the optimal switching point between two operating water pumps and three operating water pumps under the constant pressure $H_s$=17 (meters), where $Q_A=Q_{2,3}$. $f_{max}$ is the power supply frequency corresponding to the rated speed ne of the first water pump, where $Q_A=Q_1$, $f_A=f_1$. According to the data records, the frequency curve $y_1$ of an operating water pump is obtained, $Q_A=2Q_1$ and $f_A=f_1$; the frequency curve $y_2$ of two operating water pumps operating at the same frequency is obtained, $Q_A=3Q_1$ and $f_A=f_1$; the frequency curve $y_3$ of three operating water pumps operating at the same frequency is obtained. The switching point on the frequency curve $y_1$ corresponding to $Q_{1,2}$ is $f_{1,2}$. The switching point on the frequency curve $y_2$ corresponding to $Q_{1,2}$ is $f_{2,1}$. $f_{1,2}$ is the operating frequency of the frequency converter of an operating water pump at the optimal switching point. $f_{2,1}$ is the operating frequency of the frequency converter of two operating water pumps at the optimal switching point, where $f_{1,2}>f_{2,1}$. The switching point on the frequency curve $y_2$ corresponding to $Q_{2,3}$ is $f_{2,3}$. The switching point on the frequency curve $y_3$ corresponding to $Q_{2,3}$ is $f_{3,2}$. $f_{2,3}$ is the operating frequency of the frequency converter of two operating water pumps at the optimal switching point. $f_{3,2}$ is the operating frequency of the frequency converter of three operating water pumps at the optimal switching point, where $f_{2,3}>f_{3,2}$. When one water pump is operating, if $f_A>f_{1,2}$, one operating water pump is switched to two operating water pumps and $f_1>f_2$ is kept. When two water pumps are operating, if $f_A<f_{2,1}$, two operating water pumps are switched to one operating water pump. When two water pumps are operating, if $f_A>f_{2,3}$, two operating water pumps are switched to three operating water pumps and $f_1=f_2=f_3$ is kept. When three water pumps are operating, if $f_A<f_{2,3}$, three operating water pumps are switched to two operating water pumps, and $f_1=f_2$ is kept. The process requirements have time limits on the start-stop interval of water pumps. In order to avoid frequent switching of the number of operating water pumps near the optimal switching point, the value of the actual switching point is within a range near the optimal switching point. When the number of operating water pumps increases from 1 to 2, the actual switching point is $f_{1,2}$ (1+0.02), and when the number of operating water pumps decreases from 2 to 1, the actual switching point is $f_{2,1}$ (1−0.02). When the number of operating water pumps increases from 2 to 3, the actual switching point is $f_{2,3}$ (1+0.02), and when the number of operating water pumps decreases from 3 to 2, the actual switching point is $f_{3,2}$(1−0.02). That is to say, the value near the optimal switching point is used as the actual switching point value. The number of operating water pumps is maintained at the switching point, the number of operating water pumps is increased when it is greater than the actual switching point, and the number of operating water pumps is decreased when it is less than the actual switching point. These actual switching points are approximately optimal switching points. For different constant voltage operating values $H_s$, different optimal switching points and different actual switching points are obtained by the same method.

Figure 4:
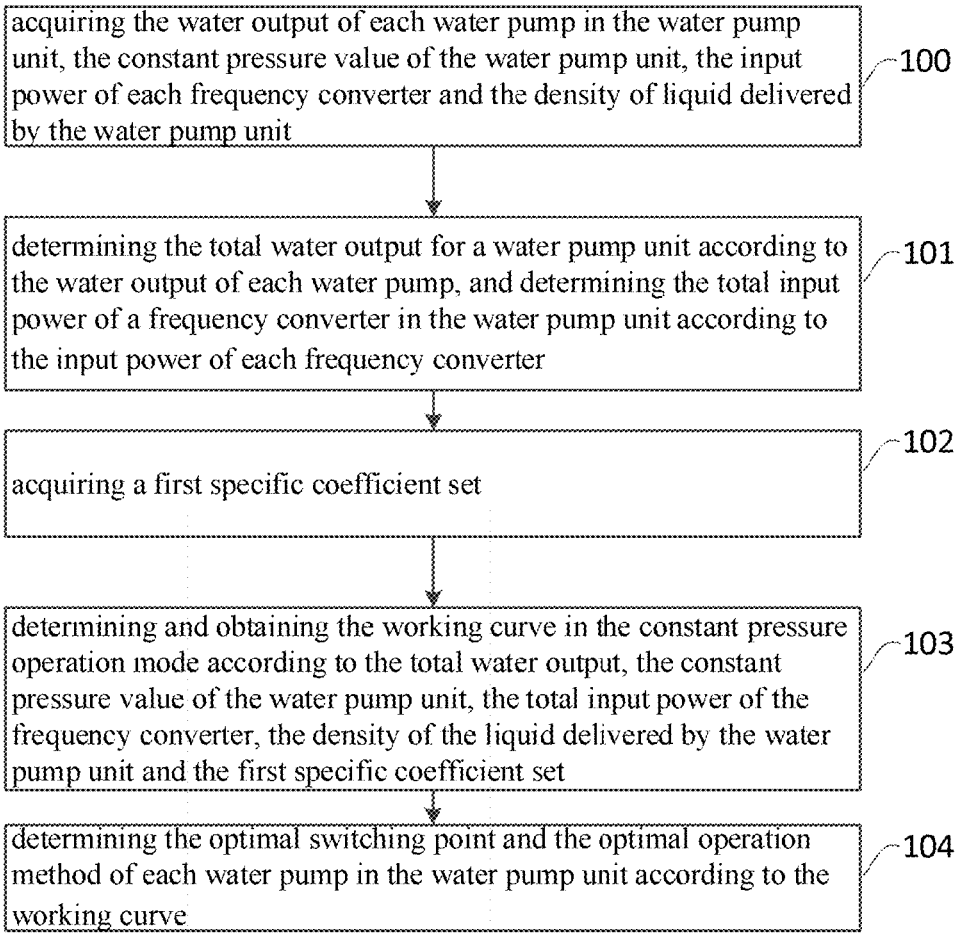
FIG. 4 is a flow chart of another power-saving optimization operation method and switching point determining method for a water pump unit according to the present disclosure.

In addition, corresponding to the technical scheme provided above, the present disclosure further correspondingly provides another power-saving optimization operation method and switching point determining method for a water pump unit. As shown in FIG. 4, the power-saving optimization operation method and switching point determining method for a water pump unit comprise:

Step 100: acquiring the water output of each water pump in the water pump unit, the constant pressure value of the water pump unit, the input power of each frequency converter and the density of liquid delivered by the water pump unit;

Step 101: determining the total water output for a water pump unit according to the water output of each water pump, and determining the total input power of a frequency converter in the water pump unit according to the input power of each frequency converter;

Step 102: acquiring a first specific coefficient set; wherein the first coefficient set comprises $\alpha$, $\varphi$, $\lambda$, $\gamma$, $\nu$, $\omega$, $\delta$, $\xi$, $\gamma\psi$, where $\nu\neq0$, $\varphi$ and $\gamma$ cannot be equal to 0 at the same time, $\varphi$ and $\delta$ cannot be equal to 0 at the same time, $\psi$ and $\delta$ cannot be equal to 0 at the same time, $\psi$ and $\delta$ cannot be equal to 0 at the same time, and $\psi$ and $\gamma$ cannot be equal to 0 at the same time;

Step 103: determining and obtaining the working curve in the constant pressure operation mode according to the total water output, the constant pressure value of the water pump unit, the total input power of the frequency converter, the density of the liquid delivered by the water pump unit and the first specific coefficient set;

Step 104: determining the optimal switching point and the optimal operation method of each water pump in the water pump unit according to the working curve;

Further, the power-saving optimization operation method and switching point determining method for a water pump unit further comprise:

Step 105: acquiring the operating frequency and a second specific coefficient set of each water pump in the water pump unit; wherein the second specific coefficient set comprises $\alpha$, $\varphi$, $\lambda$, $\gamma$, $\nu$, $\omega$, $\delta$, $\xi$, $\gamma\psi$, where $\nu\neq0$, $\varphi$ and $\gamma$ cannot be equal to 0 at the same time, $\varphi$ and $\delta$ cannot be equal to 0 at the same time, $\varphi$ and $\delta$ cannot be equal to 0 at the same time, $\psi$ and $\delta$ cannot be equal to 0 at the same time, and $\psi$ and $\gamma$ cannot be equal to 0 at the same time;

Step 106: determining and obtaining the frequency curve in the constant pressure operation mode according to the total water output, the constant pressure value of the water pump unit, the operating frequency and the second specific coefficient set;

Step 107: determining the optimal switching point and the optimal operation method of each water pump in the water pump unit according to the frequency curve and the first power-saving optimization operation method and switching point determining method described above.

In the technical scheme of another water pump unit power-saving optimization operation method and switching point determining method provided, refer to the first water pump unit power-saving optimization operation method and switching point determining method for its substantive implementation process. Because their implementation methods are basically the same, they will not be described in detail here.

In this specification, each embodiment is described in a progressive manner, and each embodiment focuses on the differences from other embodiments. It is sufficient to refer to the same and similar parts among each embodiment.

In the present disclosure, a specific example is applied to illustrate the principle and implementation of the present disclosure, and the explanation of the above embodiments is only used to help understand the method and its core idea of the present disclosure. At the same time, according to the idea of the present disclosure, there will be some changes in the specific implementation and application scope for those skilled in the art. To sum up, the contents of this specification should not be construed as limiting the present disclosure.

What is claimed is:

1. A power-saving operation method for a water pump unit, comprising:

connecting, in parallel, all water pumps in the water pump unit, wherein the water pump unit comprises a sub-pump unit A having k water pumps with an identical model and other sub-pump units having k1 water pumps with other models, each water pump is equipped with a frequency converter, k is an integer greater than 1, and k1 is an integer greater than or equal to 0;

setting the water pump unit to operate at a constant pressure, wherein a constant pressure value is $H_s$, the constant pressure value $H_s$ is a value equivalent to a total head of the water pump unit, density of delivered liquid is $\rho$, a total water output of the sub-pump unit A is $Q_A$, a total input power of frequency converters in the sub-pump unit A is $P_A$, a water output of an $i^{th}$ water pump in the sub-pump unit A is $Q_i$, where $1\leq i\leq k$, an input power of a frequency converter of the $i^{th}$ water pump is $P_i$, an operating frequency of the frequency converter of the $i^{th}$ water pump is $f_i$, then $Q_A=Q_1+Q_2+\ldots+Q_k$, $P_A=P_1+P_2+\ldots+P_k$, for the sub-pump unit A;

obtaining working curves $w_1, w_2, \ldots, w_k$ based on two coordinate variables of $\rho^{\alpha}Q_A^{\varphi}H_s^{\lambda}P_A^{\mu}$ and $\beta\rho^{\omega}Q_A^{\delta}H_s^{\xi}P_A^{\sigma}$ for the sub-pump unit A using the density of the delivered liquid, different total water outputs under different number of operating water pumps in the sub-pump unit A, the constant pressure value, different total input powers of frequency converters under different number of operating water pumps in the sub-pump unit A, wherein $\alpha$, $\varphi$, $\lambda$, $\mu$, $\beta$, $\omega$, $\delta$, $\xi$ and $\alpha$ are coefficients, $\beta\neq0$, $\varphi$ and $\mu$ cannot be equal to 0 at the same time, $\varphi$ and $\delta$ cannot be equal to 0 at the same time, $\sigma$ and $\delta$ cannot be equal to 0 at the same time, $\sigma$ and $\mu$ cannot be equal to 0 at the same time;

increasing or decreasing a number of operating water pumps in the water pump sub-pump unit A based on the working curves.

2. The method according to claim 1, wherein, obtaining the working curves $w_1, w_2, \ldots, w_k$ based on two coordinate variables of $\rho^{\alpha}Q_A^{\varphi}H_s^{\lambda}P_A^{\mu}-\beta\rho^{\omega}Q_A^{\delta}H_s^{\xi}P_A^{\sigma}$ for the sub-pump unit A using the density of the delivered liquid, different total water outputs under different number of operating water pumps in the sub-pump unit A, the constant pressure value, different total input powers of the frequency converters under different number of operating water pumps in the sub-pump unit A, comprises:

acquiring a water output $Q_1$ of only one operating water pump in the sub-pump unit A and an input power $P_1$ of a frequency converter corresponding to the one water pump, where $Q_A=Q_1$, $P_A=P_1$, and obtaining a working curve $w_1$ of the one operating water pump, acquiring a total water output of m-1 operating water pumps in the sub-pump unit A and a total input power of frequency converters of m-1 operating water pumps, wherein $Q_A=(m-1)\,Q_1$ and $P_A=(m-1)\,P_1$, where m is a positive integer, and $2\leq m\leq k$, and obtaining a working curve $w_{m-1}$ of m-1 operating water pumps operating at the same frequency, where $f_1=f_2=\ldots=f_{m-1}$;

acquiring a total water output of m operating water pumps in the sub-pump unit A and a total input power of frequency converters of m operating water pumps, wherein $Q_A=mQ_1$ and $P_A=mP_1$, where m is a positive integer, and $2\leq m\leq k$, and obtaining a working curve $w_m$ of m operating water pumps operating at the same frequency, where $f_1=f_2=\ldots=f_m$;

obtaining an intersection point of the working curve $w_{m-1}$ and the working curve $w_m$ as an optimal switching point for switching between m-1 operating water pumps and m operating water pumps under the constant pressure $H_s$, where $Q_A=Q_{m-1,\,m}$, $P_A=P_{m-1,\,m}$; at the intersection point, $H_s$ is the same, $Q_A$ is the same and $P_A$ is the same, so that efficiency of m-1 operating water pumps is the same as that of m operating water pumps, which is referred to as "equivalent switching"; $Q_{m-1,\,m}$ is an optimal switching point expressed by a total water output of the sub-pump unit A, $P_{m-1,\,m}$ is an optimal switching point expressed by a total input power of the frequency converters in the sub-pump unit A;

$f_1=f_2=\ldots=f_{m-1}$ when the m-1 water pumps operate, $f_1=f_2=\ldots=f_m$ when the m water pumps operate, and frequency converters corresponding to operating water pumps in the sub-pump unit A at the same output frequency, which is referred to as "same pump with same frequency", such that $Q_i$, $P_i$, $H_s$ and operating efficiency of each operating water pump are the same.

3. The method according to claim 2, after obtaining the intersection point of the working curve $w_{m-1}$ and the working curve $w_m$ as the optimal switching point for switching between m-1 operating water pumps and m operating water pumps under the constant pressure $H_s$, the method further comprising:

acquiring a value of any one of $Q_{m-1,\ m}$ and $P_{m-1,\ m}$;

acquiring an optimal value of the value of any one of $Q_{m-1,\ m}$ and $P_{m-1,\ m}$ multiplied by $(1-\theta_1)$ when the number of operating water pumps increases from m-1 to m, where $0\leq\theta_1\leq0.15$, and an optimal value of the value of any one of $Q_{m-1,\ m}$ and $P_{m-1,\ m}$ multiplied by $(1-\varepsilon_1)$ when the number of operating water pumps is reduced from m to m-1, where $0\leq\varepsilon_1\leq0.15$.

4. The method according to claim 2, after obtaining the intersection point of the working curve $w_{m-1}$ and the working curve $w_m$ as the optimal switching point for switching between m-1 operating water pumps and m operating water pumps under the constant pressure $H_s$, the method further comprising:

obtaining frequency curves y on different number of operating water pumps in the sub-pump unit A using two coordinate variables of $\rho^{\alpha}Q_A^{\varphi}H_s^{\lambda}f_A^{\gamma}$ and $\nu\rho_{\omega}Q_A^{\delta}H_s^{\xi}f_A^{\psi}$, where $\alpha$, $\varphi$, $\lambda$, $\gamma$, $\nu$, $\omega$, $\delta$, $\xi$, $\psi$ are coefficients, $\nu\neq0$, $\varphi$ and $\gamma$ cannot be equal to 0 at the same time, $\varphi$ and $\delta$ cannot be equal to 0 at the same time, $\psi$ and $\delta$ cannot be equal to 0 at the same time, and $\psi$ and $\gamma$ cannot be equal to 0 at the same time;

obtaining optimal frequency switching points, on the frequency curves y when setting $\alpha=0$, $\varphi=1$, $\lambda=0$, $\gamma=0$, $\nu=1$, $\omega=0$, $\delta=0$, $\xi=0$, $\psi=1$, using $Q_{m-1,\ m}$ obtained by the working.

5. The method according to claim 4, wherein obtaining the optimal frequency switching point, on the frequency curves y when setting $\alpha=0$, $\varphi=1$, $\lambda=0$, $\gamma=0$, $\nu=1$, $\omega=0$, $\delta=0$, $\xi=0$, $\psi=1$, using $Q_{m-1,\ m}$ obtained by the working curves, comprises:

acquiring the water output $Q_1$ of only one operating water pump in the sub-pump unit A and the frequency $f_1$ of a corresponding frequency converter of the one operating water pump, where $Q_A=Q_1$, $f_A=f_1$, $f_A$ represents a frequency value when output frequencies of all operating frequency converters in the sub-pump unit A are the same; and obtaining a frequency curve $y_1$ of the one operating water pump based on two coordinate variables of $Q_A$ and $f_A$;

obtaining a frequency curve $y_{m-1}$ of m-1 operating water pumps operating at the same frequency based on two coordinate variables of $Q_A$ and $f_A$, wherein $Q_A=(m-1)Q_1$, where m is a positive integer and $2\leq m\leq k$, and $f_A=f_1=f_2=\ldots=f_{m-1}$;

obtaining a frequency curve $y_m$ of m operating water pumps operating at the same frequency based on two coordinate variables of $Q_A$ and $f_A$, wherein $Q_A=mQ_1$, and $f_A=f_1=f_2==f_m$;

obtaining a frequency switching point $f_{m-1,\ m}$ on the frequency curve $y_{m-1}$ corresponding to $Q_{m-1,\ m}$, and a frequency switching point $f_{m,\ m-1}$ on the frequency curve $y_m$ corresponding to $Q_{m-1,\ m}$, wherein $f_{m-1,\ m}$ is an operating frequency of the frequency converters of m-1 operating water pumps at the optimal switching point $Q_{m-1,\ m}$ obtained by the working curve $w_{m-1}$ and the working curve $w_m$, and $f_{m,\ m-1}$ is an operating frequency of the frequency converters of m operating water pumps at the optimal switching point $Q_{m-1,\ m}$, where $f_{m-1,\ m}>f_{m,\ m-1}$.

6. The method according to claim 5, after obtaining the frequency switching point $f_{m-1,\ m}$ on the frequency curve $y_{m-1}$ corresponding to $Q_{m-1,\ m}$, and the frequency switching point $f_{m,\ m-1}$ on the frequency curve $y_m$ corresponding to $Q_{m-1,\ m}$, the method further comprising:

obtaining an optimal frequency switching point where a frequency value is a frequency value of $f_{m-1,\ m}$ multiplied by $(1+\theta_2)$ when the number of operating water pumps increases from m-1 to m, where $0\leq\theta_2\leq0.15$, and an optimal frequency switching point where a frequency value is a frequency value of $f_{m,\ m-1}$ multiplied by $(1-\varepsilon_2)$ when the number of operating water pumps is reduced from m to m-1, where $0\leq\varepsilon_2\leq0.15$.

7. The method according to claim 2, wherein, the variable $\beta\rho^{\omega}Q_A^{\delta}H_s^{\xi}P_A^{\sigma}$ is $\beta_1\rho Q_A H_s/P_A$ when $\omega=1$, $\delta=1$, $\xi=1$, $\sigma=-1$ and $\beta=\beta_1$, wherein $\beta_1\rho Q_A H_s/P_A$ represents operating efficiency $\eta(H_s)$ of the sub-pump unit A, $\beta_1$ is a coefficient, and when $Q_A\geq Q_{1,2}$, the operating efficiency of the sub-pump unit A is $\eta(H_s)\geq\beta_1\rho Q_{1,2}H_s/P_{1,2}$.

8. The method according to claim 2, wherein, a control of the "same pump with same frequency" is implemented by sending a frequency value to all frequency converters at one time via a bus communication signal and an analog output signal of a controller.

* * * * *